United States Patent [19]

Cantera et al.

[11] 4,056,387

[45] Nov. 1, 1977

[54] LEADED STEEL BAR FREE OF LEAD MACROINCLUSIONS

[75] Inventors: Gregorio Asua Cantera; Jose M. Palacios Reparaz, both of Bilbao, Spain; Louis Molnar, Hammond, Ill.

[73] Assignees: Inland Steel Company, Chicago, Ill.; S.A. Echevarria, Bilbao, Spain

[21] Appl. No.: 638,675

[22] Filed: Dec. 8, 1975

Related U.S. Application Data

[63] Continuation of Ser. No. 497,258, Aug. 14, 1974, abandoned, which is a continuation-in-part of Ser. No. 403,065, Oct. 3, 1973, Pat. No. 3,876,422, which is a continuation-in-part of Ser. No. 256,806, May 25, 1972, abandoned.

[51] Int. Cl.[2] ..... C22C 37/00

[52] U.S. Cl. ..... 75/123 F; 75/129; 148/36

[58] Field of Search ..... 75/123 F, 129, 46; 148/36; 266/34 T

[56] References Cited

U.S. PATENT DOCUMENTS

| | | | |
|---|---|---|---|
| 3,632,096 | 1/1972 | Perry | 75/46 |
| 3,634,074 | 1/1972 | Ito et al. | 75/125 |
| 3,671,224 | 6/1972 | North et al. | 75/123 F |
| 3,814,405 | 6/1974 | Ormaechea | 266/34 T |
| 3,869,283 | 3/1975 | Davies et al. | 75/129 |
| 3,876,422 | 4/1975 | Cantera et al. | 75/123 F |
| 3,948,649 | 4/1976 | Takahashi et al. | 75/123 F |

*Primary Examiner*—Walter R. Satterfield

*Attorney, Agent, or Firm*—Merriam, Marshall & Bicknell

[57] ABSTRACT

Leaded steel bar containing 0.05–0.70 wt. % lead. No substantial amount of complex macroinclusions in immediate sub-surface region, the machinability of which is relatively high. Process for making such leaded steel is described.

5 Claims, 3 Drawing Figures

LEADED STEEL BAR FREE OF LEAD MACROINCLUSIONS

RELATED APPLICATIONS

This is a continuation of application Ser. No. 497,258, filed Aug. 14, 1974 and now abandoned. Application Ser. No. 497,258 is a continuation-in-part of application Ser. No. 403,065 filed Oct. 3, 1973 entitled "Elongated Leaded Steel Casting," now U.S. Pat. No. 3,876,422. Ser. No. 403,065 was in turn a continuation-in-part of application Ser. No. 256,806 filed May 25, 1972, entitled "Method For Adding Lead to Steel In a Ladle" and now abandoned. The disclosures of all of those antecedent applications are incorporated herein by reference.

BACKGROUND OF THE INVENTION

The present invention relates generally to free machining steels and more particularly to leaded steel bars.

Steel bars may be machined with form tools or drill tools. Typically, a form tool is applied to the peripheral surface of the steel bar and advances inward in a direction normal to the surface, as the bar rotates, whereas a drill tool is applied to the center of the steel bar and advances in an axial direction in a typical operation involving a screw machine.

Form tool machinability may be expressed in terms of cubic inches of metal removed until form tool failure or it may be expressed as part growth, which reflects tool wear which is inversely proportional to machinability. In conventional leaded steel bars, the form tool machinability of the steel bar at the immediate sub-surface region of the bar is significantly lower than the form tool machinability nearer the center or at the interior of the leaded steel bar. The immediate sub-surface region of the steel bar is, for example, at a depth of one-sixteenth - three-sixteenth inch in absolute distance from the surface of the steel bar in a 2-13/16 inches diameter bar. This is about 5-15% of the depth to the center of the bar. As the diameter of the bar decreases from 2-13/16 inches, the immediate sub-surface region in which the lower machinability appears is closer, in absolute distance, to the surface of the bar; and in bars larger than 2-13/16 inches, the immediate sub-surface region lies farther from the surface of the bar, in absolute distance.

In the immediate sub-surface region of conventional leaded steel bars, there are complex macroinclusions whose composition is described below. A macroinclusion is an inclusion which is visible at 1 to 10X magnification. (A microinclusion is an inclusion which is visible at greater than 10X magnification). In rolled bars, the macroinclusions are elongated in the direction of rolling.

As used herein, the term "complex macroinclusions" refers to macroinclusions which comprise oxides of manganese, silicon and iron, with metallic lead interspersed therein. These complex macroinclusions have an adverse effect on machinability. These complex macroinclusions are not the same as the lead macroinclusions disclosed as occurring in the surface or sub-surface region of prior art leaded steel by North et al., U.S. Pat. No. 3,671,224, Col. 2, lines 56-60, which teaches how to avoid such lead macroinclusions and refers to them as lead "streaks or blobs".

SUMMARY OF THE INVENTION

The present invention is a leaded steel bar in which the immediate sub-surface region of the bar has a relatively high form tool machinability. The bar contains lead in machinability-improving amounts, 0.05-0.70 wt. %, preferably greater than 0.15 up to 0.50 wt. %. The lead content is uniformly dispersed throughout the bar, and the lead content of the bar is contained in microinclusions, there being no substantial amount of lead-containing macroinclusions.

The immediate sub-surface region of the bar has no substantial amount of complex macroinclusions i.e., it is substantially free of complex macroinclusions. The phrase "no substantial amount of complex macroinclusions", used herein with respect to the immediate sub-surface region of the bar, refers to a reduced amount of such macroinclusions sufficiently small so that (1) the form tool machinability of the immediate sub-surface region is greater than 50% of the form tool machinability of the bar's interior and preferably greater than 75% or (2) the form tool machinability of the immediate sub-surface region is about 90% or more of the form tool machinability of the bar as a whole (i.e., the immediate sub-surface region plus the interior) or (3) both of the above. The above comparisons of form tool machinability are in terms of cubic inches of metal removed until tool failure; and, with the percentages noted above, the form tool machinability of the immediate subsurface region is relatively high compared to conventional leaded steel bars. After machining, the bar also has an improved surface quality over conventional leaded steel bars.

Other features and advantages are inherent in the subject matter claimed and disclosed or will become apparent to those skilled in the art from the following detailed description in conjunction with the accompanying diagrammatic drawings.

DETAILED DESCRIPTION OF PREFERRED EMBODIMENTS

Leaded steel bars produced in accordance with the present invention are rolled from ingots or strand cast products in turn cast from molten steel. Conventional sizes and physical configurations of such ingots and strand cast products are described in parent application Ser. No. 403,065, and the description thereof relating to the size and physical configuration of such ignots and strand cast products is incorporated herein by reference.

The base composition of the steel (i.e., the steel composition without lead) includes virtually all base compositions to which lead has heretofore been added to the extent that they are not inconsistent with the description herein. The base composition for some typical grades of plain carbon steels may be in the following range:

| Element | Wt. % |
|---|---|
| carbon | .03–1.03 |
| manganese | .25–1.65 |
| sulfur | .01–.50 |
| phosphorus | .005–.20 |
| silicon | .01–.05 |
| nitrogen | .03 max. |
| iron | essentially the balance |

For other grades of plain carbon steel and for alloy steels, the base composition may contain, in addition to the above-listed elements, one or more of the following alloying elements:

| Element | Wt. % |
|---|---|
| chromium | .01–1.70 |
| nickel | .01–3.75 |
| molybdenum | .01–.50 |
| vanadium | 0–.25 |
| boron | 0–.003 |
| titanium | 0–.50 |
| zirconium | 0–.25 |
| columbium | 0–.25 |
| aluminum | .005–.10 |
| calcium | .001–.02 |
| tellurium | 0–.15 |
| silicon | up to 1.00 |

Typical examples of such base compositions in the AISI 1200 series of steels are within the following ranges:

| Element | Wt. % |
|---|---|
| carbon | 0.15 max. |
| manganese | 0.60–1.15 |
| phosphorus | 0.04–0.12 |
| sulfur | 0.08–0.35 |
| iron | essentially the balance |

To such base compositions, lead is added, to provide a final lead content greater than 0.05 wt. % and typically up to 0.70 wt. %. Preferably, the lead content is in a range greater than 0.15 up to 0.50 wt. %.

Figure 1:
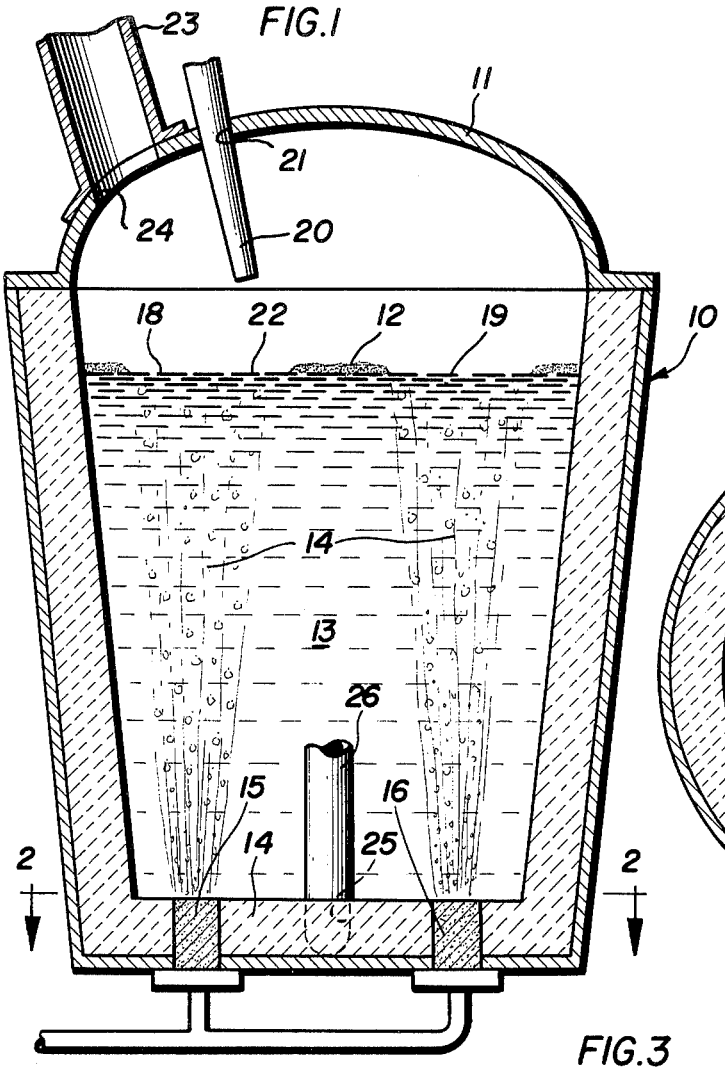
FIG. 1 is a diagrammatic vertical sectional view illustrating apparatus for adding lead to steel in a ladle to produce a leaded steel bar in accordance with the present invention.
Figure 2:
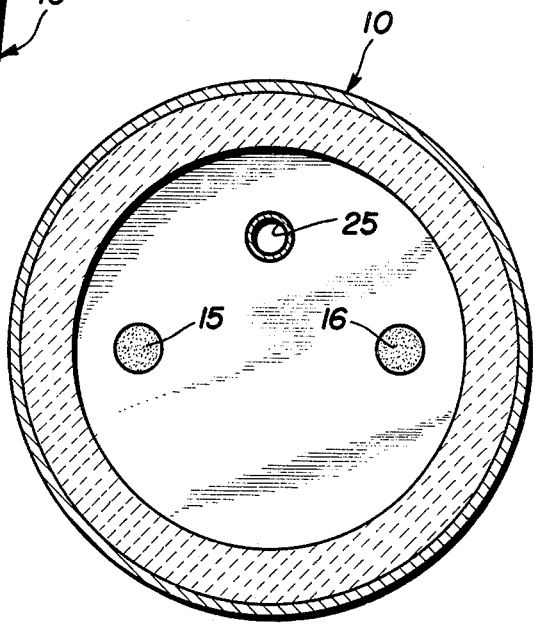
FIG. 2 is a sectional view taken along line 2—2 in FIG. 1.

Prior to casting the steel into ingot or strand form, the lead is added to the steel in the manner described below, referring to FIGS. 1 and 2.

Molten steel of the desired composition, and at a temperature in the range 2900°–3100° F., is tapped from a conventional steel-making furnace into a ladle 10 while retaining most of the slag in the furnace. The ladle is covered with a cover 11 to isolate the ladle interior from the outside atmosphere. Only a very thin layer of slag 12 covers the bath 13 of molten steel in the ladle at this time.

The ladle bottom 14 contains an outlet 25 closed by a removable stopper rod 26 and a pair of porous plugs 15, 16, spaced apart, through which inert argon gas is introduced into the bath. The rising argon gas bubbles 17 stir the molten steel and, where the argon bubbles breach the surface of the bath, at 18, 19, the slag layer 12 is pushed aside uncovering a portion of the top of molten steel bath 13. After introducing argon to the steel for 15–60 seconds, lead is introduced through a conduit 20 in a port 21 in ladle cover 11 onto the top of the bath at a portion 18 of the bath surface not covered by the slag, but at a location 22 not directly over a porous plug 15, 16. Argon stirring is continued during the lead-adding step which takes about 2–3 minutes, and stirring with argon gas also continues for 2–3 minutes after the lead-adding step.

Gases accumulating at the top of the ladle during the argon stirring and lead-adding steps (e.g., argon and lead fumes) are exhausted through an exhaust conduit 23 communicating with an exhaust opening 24 in ladle cover 11. A conventional exhaust blower (not shown) may be used to help remove gases accumulating at the top of the bath inside the ladle. Removal of gases can be controlled to provide a pressure within the covered ladle greater than atmospheric. A gaseous atmosphere, less oxidizing than the atmosphere outside the ladle, is maintained over the bath inside the covered ladle, during the lead-adding step and thereafter.

Sufficient lead is added to give the desired final lead content. No rare earths are added to the steel; and the atmosphere within the ladle at the time the lead is added is less oxidizing than the atmosphere outside the ladle, a condition which is less favorable to the formation of lead oxide than if the atmosphere within the ladle were the same as the outside atmosphere.

After the lead has been added and after the leadcontaining bath has been stirred with argon gas, as described above, introduction of argon gas is stopped, cover 11 is removed from ladle 10, the top of the bath is covered with expanded vermiculite or similarly-acting material to suppress fuming, and the lead-containing molten steel is teemed into conventional ingot molds (either big end up or big end down) or into the tundish of a conventional strand caster producing continuous cast steel. The temperature of the steel at the time of teeming is about 2850° F or higher.

The porous plugs are purged with an oxygen blow for about 5–10 seconds just before introducing the argon and for about 30–60 seconds after dumping the slag following teeming.

A further description of methods for adding lead to steel in a covered ladle is contained in our application Ser. No. 256,806 filed May 25, 1972 and entitled "Method For Adding Lead To Molten Steel In A Ladle", and the description of such methods is incorporated herein by reference.

Those methods comprise embodiments in which the molten steel is deslagged before it is added to the ladle or the slag is prevented from entering the ladle when the molten steel is poured into the ladle. In both such cases, the bath in the ladle is substantially free of slag. At the most there would be no more than a very thin layer of slag.

After casting into either ingots or strand cast products, using conventional casting procedures, the solidified leaded steel form is rolled into a bar, using conventional rolling procedures.

The result is a leaded steel bar which, in the as-rolled condition, has an immediate sub-surface region with a relatively high form-tool machinability with no substantial amount of complex macroinclusions in the immediate sub-surface region or in the interior.

The lead is predominantly present in the steel bar in microinclusions relatively uniformly distributed throughout the length and cross-section of the bar. The lead in the microinclusions consists essentially of elemental lead. When both tellurium and lead are added to the steel to improve machinability the lead may be combined with the tellurium as lead telluride. The lead may be unassociated with other inclusions, or it may be associated with inclusions such as manganese sulfide. Virtually none of the lead is present as lead oxide, no lead oxide having been found upon inspection of the microscopic inclusions containing lead. This condition occurs even in the absence of aluminum in amounts normally present when aluminum is added to kill the steel or refine the grain size (e.g., 0.015–0.065 wt. %).

Tests were conducted to compare the machinability of leaded steel bars in accordance with the present invention and conventional leaded steel bars. For all comparisons herein, the conventional leaded steel bar was made by a process in which lead was added to the steel at the ingot mold. Representative results (minus anomalies) from the aforementioned tests are described below.

Table I sets forth the composition of a number of conventional leaded steel bars (samples 44542–549) and of leaded steel bars in accordance with the present invention (samples 44554–556 and 44558–559). Tests run on these bars are reflected by Tables II and III.

Table I

| Sample No. | Wt. % C | Mn | P | S | Pb |
|---|---|---|---|---|---|
| 44542 | .09 | 1.11 | .08 | .34 | .25 |
| 44543 | .08 | 1.06 | .07 | .29 | .21 |
| 44544 | .08 | 1.05 | .06 | .26 | .20 |
| 44545 | .06 | 1.03 | .08 | .28 | .21 |
| 44546 | .07 | 1.07 | .07 | .30 | .23 |
| 44547 | .06 | 1.04 | .06 | .29 | .22 |
| 44548 | .06 | .82 | .07 | .30 | .23 |
| 44549 | .08 | .82 | .08 | .30 | .21 |
| 44554 | .09 | .96 | .08 | .33 | .40 |
| 44555 | .09 | .94 | .08 | .30 | .39 |
| 44556 | .07 | .97 | .08 | .29 | .65 |
| 44558 | .06 | .86 | .08 | .33 | .38 |
| 44559 | .06 | .85 | .07 | .33 | .38 |

Table II compares the form-tool machinability at the immediate sub-surface region with the form-tool machinability at the interior, for both conventional leaded steel bars (samples 44542–549) and leaded steel bars in accordance with the present invention (samples 44554–559).

Each of the tests reflected in Table II utilized a round bar having a 2 13/16 in. diameter which was machined about 1/16 in. to 2¾ in. to true the bar. On each bar there was a ⅛ in. radial plunge, to test the machinability of the immediate sub-surface region (column (X)). After completion of the tests involving the ⅛ in. plunge, the bar was then turned down to 2½ in. (to remove the immediate sub-surface region) and a ½ in. radial plunge was taken, further down the bar length from where the ⅛ in. plunge was taken, to test the machinability of the bar interior (column (Y)). The turning speed of the bar was adjusted so that, on the ½ in. plunge, the same surface speed prevailed as on the previous ⅛ in. plunge, the surface speed at the surface of the 2¾ in. bar being 313 surface feet per minute while the surface speed at the surface of the 2½ in. bar being 343 surface feet per minute.

Table II

| Sample No. | Cubic inches of metal removed until tool failure for: (X) ⅛ in. plunge on 2¾ in. bar | (Y) ½ in. plunge on same bar after removal of outer ¼ in. | $\frac{(Y)-(X)}{(X)}$ 100% | $\frac{(X)}{(Y)}$ 100% |
|---|---|---|---|---|
| 44542 | 2.3 | 7.2 | 213% | 32% |
| 44543 | 1.7 | 7.5 | 341% | 23% |
| 44544 | 1.6 | 6.3 | 294% | 25% |
| 44545 | 1.2 | 11.3 | 842% | 11% |
| 44546 | 2.5 | 13.4 | 436% | 19% |
| 44547 | 1.9 | 12.8 | 574% | 15% |
| 44548 | 5.6 | 13.9 | 148% | 40% |
| 44549 | 6.8 | 14.6 | 115% | 47% |
| 44554 | 7.2 | 11.4 | 58% | 63% |
| 44555 | 9.4 | 13.1 | 39% | 72% |
| 44556 | 8.1 | 13.1 | 61% | 62% |
| 44558 | 13.4 | 17.2 | 28% | 77% |
| 44559 | 11.4 | 20.7 | 81% | 55% |

Table III compares the change in tool life, expressed as cubic inches removed until tool failure, between a bar on which one form tool test (column (a)) is on the outer ⅛ in. of a 2¾ in. diameter bar and another form tool test (column (b)) is on the outer ½ in. of the same bar. Test (b) of Table III reflects the machinability when cutting through both the immediate sub-surface region and the bar interior, in contrast to test (Y) of Table II which reflects a cut through the bar interior after removal of the immediate sub-surface region.

Table III

| Sample No. | Cubic inches of metal removed until tool failure when machining on: (a) outer ⅛ in. | (b) outer ½ in. | $\frac{(a)}{(b)}$ 100% |
|---|---|---|---|
| 44542 | 2.3 | 4.5 | 51% |
| 44543 | 1.7 | 3.2 | 53% |
| 44544 | 1.6 | 2.8 | 57% |
| 44545 | 1.2 | 4.5 | 27% |
| 44546 | 2.5 | 4.9 | 51% |
| 44547 | 1.9 | 4.5 | 42% |
| 44548 | 5.6 | 8.5 | 66% |
| 44549 | 6.8 | 8.9 | 79% |
| 44554 | 7.2 | 6.7 | 108% |
| 44555 | 9.4 | 9.0 | 104% |
| 44556 | 8.1 | 8.4 | 96% |
| 44558 | 13.4 | 10.9 | 123% |
| 44559 | 11.4 | 12.7 | 90% |

Figure 3:
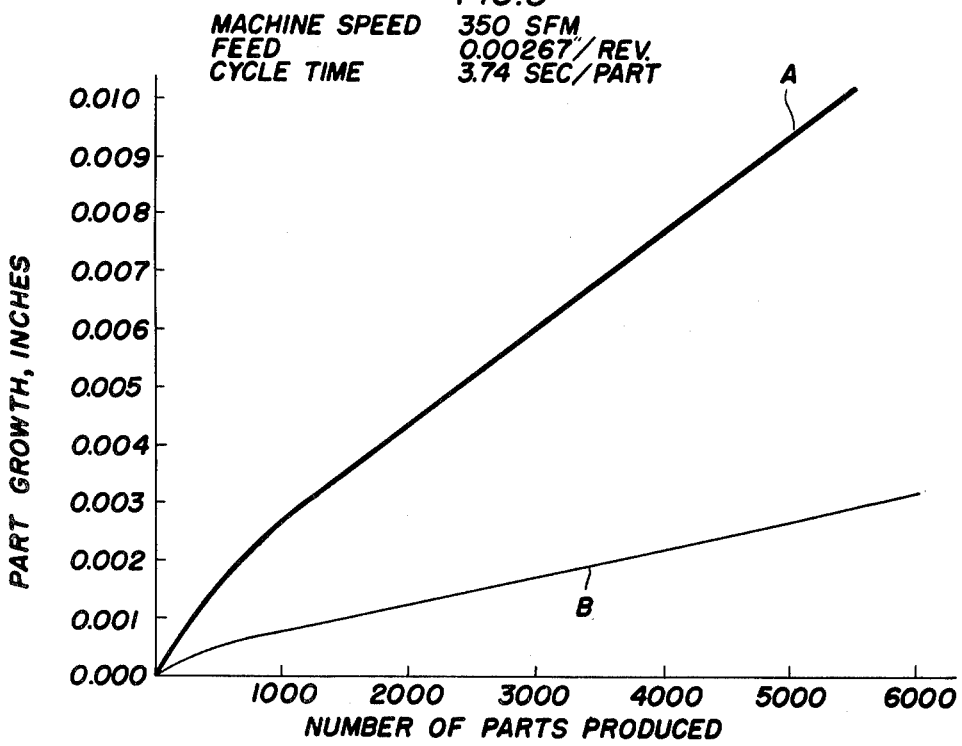
FIG. 3 is a graph comparing machinability, in terms of part growth, of (1) a conventional leaded steel bar and (2) a leaded steel bar in accordance with the present invention.

FIG. 3 compares the machinability, expressed in terms of part growth on the part undergoing form tool machining, of (A) conventional leaded steel bars and (B) leaded steel bars in accordance with the present invention. Part growth is an indication of tool wear which is inversely proportional to machinability. However, the amount of part growth is not the same as the amount of tool wear. Because of the mechanical factors involved, the former is greater than the latter for a given run of parts. Generally, part growth greater than 0.010 in. is commercially unacceptable.

The leaded steel bars A and B of FIG. 3 were cold drawn 1 inch rounds and had the following composition:

| Element | Wt. % |
|---|---|
| Carbon | .06–.15 |
| Manganese | .85–1.15 |
| Phosphorus | .04–.09 |
| Sulfur | .26–.35 |
| Lead | .20–.30 |
| Iron | essentially the balance |

Table II shows that a leaded steel bar in accordance with the present invention has a form tool machinability in its immediate sub-surface region which is 55–77% of the form tool machinability of the bar's interior compared to 11–47% for a conventional leaded steel bar.

Table III shows that, for a leaded steel bar in accordance with the present invention (samples 44554–559), the machinability of the immediate sub-surface region (test (a)) is 90–123% of the machinability of the bar as a whole (immediate sub-surface region and interior) (test (b)) whereas for a conventional leaded steel bar (samples 44542–549), the immediate sub-surface machinability (test (a)) is 27–79% of the machinability of the bar as a whole (test (b)).

FIG. 3 shows that, for a leaded steel bar in accordance with the present invention, part growth, for a run of 5000 parts using form-tool machining, is one-third that of a conventional leaded steel bar (0.003 in. vs. 0.009 in.).

As noted above, the form-tool machinability of a leaded steel bar in accordance with the present invention is superior to that of a conventional leaded steel bar for all lead contents. Moreover, the drill-tool machinability of a leaded steel bar in accordance with the present invention is at least comparable to that of the conventional leaded steel bar.

Leaded steel bars have generally had a lead content up to about 0.35 wt. %. With higher lead contents (e.g., .40–.50 wt. %), a leaded steel bar in accordance with the present invention has improved machinability of both types (form-tool and drill-tool). Conventional leaded steel bars could not be produced in commercial scale operations at the higher lead content.

After machining, a leaded steel bar in accordance with the present invention has an improved surface finish compared to a conventional leaded steel bar.

With respect to mechanical properties (e.g., yield strength, ultimate tensile strength and ductility, expressed as percent total elongation in 2 inches) the leaded steel bar of the present invention is comparable to a conventional leaded steel bar.

Tests were run to determine the effect on productivity (number of parts produced per work turn) when a leaded steel bar in accordance with the present invention and containing an increased lead content (0.40–0.50 wt. % lead) was substituted for a conventional leaded steel bar containing more conventional amounts of lead (0.15–0.35 wt. % lead). Otherwise the composition was in the ranges described above for bars A and B in FIG. 3. The results are set forth below.

In the production of a crimped ferrule from a 2 1/16 in. cold drawn round, wherein a recess tool was the critical machining tool, there was a 10% increase in productivity. A recess tool cuts grooves on the inside surface of an axially drilled hole, for example.

In the production of a gas-control flange from a 31/32 in. cold drawn round, in which form-tool machining was the critical form of machining, there was a 30% increase in productivity.

In the production of hose couplings from 1¼ in. and 2 in. hexagonal bars, in which both form-tool and drilltool machining were critical, there was a 1% increase in productivity.

In the production of hose couplings from 7/8 in. cold drawn hexagons, in which form-tool and drill-tool machining were critical, there was a 17% increase in productivity.

In the production of a shaft end sleeve, from a 15/16 in. cold drawn round, in which both form-tool and drill-tool machining were used but in which recess tool machining was critical, there was an increase in productivity of 16–23%.

The foregoing detailed description has been given for clearness of understanding only, and no unnecessary limitations should be understood therefrom as modifications will be obvious to those skilled in the art.

What is claimed is:

1. An as-rolled, free machining steel bar having ingredients consisting essentially of, in wt. %:

| | |
|---|---|
| carbon | .03 – 1.03 |
| manganese | .25 – 1.65 |
| sulfur | .01 – .50 |
| phosphorus | .005 – .20 |
| silicon | .01 – .05 |
| nitrogen | .03 max. |
| lead | .40 – .50 |
| iron | essentially the balance; |

the entire lead content of said bar being uniformly dispersed throughout said bar, with substantially all of said dispersed lead being contained in microinclusions;

said bar being substantially free of lead macroinclusions;

said steel bar having an immediate sub-surface region which comprises about 5–15% of the depth from the surface to the center of said bar;

said immediate sub-surface region being substantially free of complex macroinclusions comprising oxides of manganese, silicon and iron with metallic lead interspersed therein;

the form-tool machinability of said immediate sub-surface region, expressed in terms of cubic inches of metal removed until tool failure, being greater than 50% of the form-tool machinability of the bar's interior.

2. A steel bar as recited in claim 1 wherein the entire bar is substantially free of said complex macroinclusions.

3. A steel bar as recited in claim 1 wherein the form-tool machinability of said immediate sub-surface region is greater than 75% of the form-tool machinability of the bar's interior.

4. A steel bar as recited in claim 1 wherein said immediate sub-surface region has a form-tool machinability greater than about 90% of the form-tool machinability of the bar as a whole.

5. A steel bar as recited in claim 1 and further containing at least one of the following additional ingredients, in wt. %:

| | |
|---|---|
| chromium | .01 – 1.70 |
| nickel | .01 – 3.75 |
| molybdenum | .01 – .50 |
| vanadium | 0 – .25 |
| boron | 0 – .003 |
| titanium | 0 – .50 |
| zirconium | 0 – .25 |
| columbium | 0 – .25 |
| aluminum | .005 – .10 |
| calcium | .001 – .02 |
| tellurium | 0 – .15 |
| silicon | up to 1.00 |

* * * * *